US005890657A

United States Patent [19]

Ponte

[11] Patent Number: 5,890,657

[45] Date of Patent: Apr. 6, 1999

[54] SPRINKLER ARRANGEMENT

[75] Inventor: Gary W. Ponte, Livingston, N.J.

[73] Assignee: The Reliable Automatic Sprinkler Co., Inc., Mount Vernon, N.Y.

[21] Appl. No.: 790,162

[22] Filed: Jan. 28, 1997

[51] Int. Cl.[6] ..... B05B 1/26

[52] U.S. Cl. ..... 239/518; 239/498; 169/37

[58] Field of Search ..... 239/498, 518; 169/37

[56] References Cited

U.S. PATENT DOCUMENTS

| | | | |
|---|---|---|---|
| 316,581 | 4/1885 | Stratton | 169/37 |
| 466,658 | 1/1892 | Cumnock et al. | 169/137 |
| 550,968 | 12/1895 | Hart | 169/37 X |
| 1,028,940 | 6/1912 | Hunter | 169/39 |
| 1,885,219 | 7/1932 | Bills et al. | 169/37 |
| 4,099,675 | 7/1978 | Wohler et al. | 16/37 |
| 4,280,562 | 7/1981 | Glinecke | 169/37 X |
| 4,700,893 | 10/1987 | Bugler, III | 239/498 |
| 5,579,846 | 12/1996 | Meyer et al. | 169/37 |
| 5,687,914 | 11/1997 | Bosio et al. | 239/498 |

*Primary Examiner*—Andres Kashnikow
*Assistant Examiner*—Robin O. Evans
*Attorney, Agent, or Firm*—Baker & Botts, L.L.P.

[57] ABSTRACT

In the representative embodiments described in the specification, a pendent sprinkler has a sprinkler body with an axial passage for fire extinguishing liquid and a pair of frame arms supporting a deflector at a location spaced from the end of the axial passage. In order to provide high density water with uniform distribution throughout an area to be protected, the deflector is formed with a circumferential array of slots, each of which is oriented at an angle with respect to a radius line extending through the inner end of the slot. Preferably the angle of orientation of each slot is about 35°.

15 Claims, 2 Drawing Sheets

SPRINKLER ARRANGEMENT

BACKGROUND OF THE INVENTION

This invention relates to fire prevention sprinklers for distributing liquid in an environment which is subject to a fire hazard.

Most conventional fire prevention sprinklers consist of a sprinkler body connected to a liquid supply pipe to receive fire extinguishing liquids such as water and having a heat-responsive valve arrangement blocking a passage in the sprinkler body which is set to open the passage when the temperature in the vicinity of the sprinkler exceeds a selected value. In order to distribute the water emerging from the sprinkler passage throughout the area to be protected, the sprinkler includes a deflector supported from the sprinkler body, usually by a frame consisting of two arms projecting beyond the sprinkler passage on opposite sides of the path of emerging water. Alternatively, the deflector may be supported from the sprinkler body by sliding pins rather than fixed arms, allowing the deflector to be optimally positioned automatically and concurrently with the operation of the sprinkler as is required with certain types of concealed sprinklers.

In many cases, the sprinkler deflector consists of a substantially planar disk positioned perpendicularly to the sprinkler passage to distribute water impinging on the deflector radially outwardly in the direction parallel to the plane of the disk. The deflector is usually formed with radially extending slots which permit a portion of the impinging water to pass through the disk, i.e., downwardly toward the floor of the protected area when the sprinkler is of the pendent type suspended from a ceiling. Deflectors of this type are described, for example, in the Meyer et al. U.S. Pat. Nos. 5,366,022 and 5,579,846. In many instances, however, it is desirable to provide a higher water density over the region to be protected by the sprinkler than can be provided by such sprinklers in order to assure adequate protection in particular situations such as, for example, rack storage of items such as plastics and other flammable items in corrugated containers.

SUMMARY OF THE INVENTION

Accordingly, it is an object of the present invention to provide a sprinkler arrangement which overcomes the disadvantages of the prior art.

Another object of the invention is to provide a sprinkler arrangement which is effective to apply water at high densities to a region to be protected.

These and other objects of the invention are attained by providing a sprinkler which includes a sprinkler body having an axial passage to supply water under pressure and a deflector supported in spaced relation to the axial passage and substantially perpendicularly to the axis of the passage, the deflector being formed around its periphery with a plurality of slots each of which extends at an angle to a radial line from the center of the deflector to the inner end of the slot. The angle to the radial line at which each slot extends is preferably in the range from about 200 to about 500, desirably in the range from about 300 to about 400, and most desirably about 350. Each slot has a width which is preferably in the range from about 0.04 inch to 0.08 inch and desirably about 0.06 inch.

For high water density coverage of relatively small areas to be protected i.e., up to about 10 feet by 10 feet, the diameter of the deflector may be in the range from about 1.1 inch to about 1.2 inch and preferably about 1.15 inch and, for high density coverage of larger areas, larger diameter deflectors may be used.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
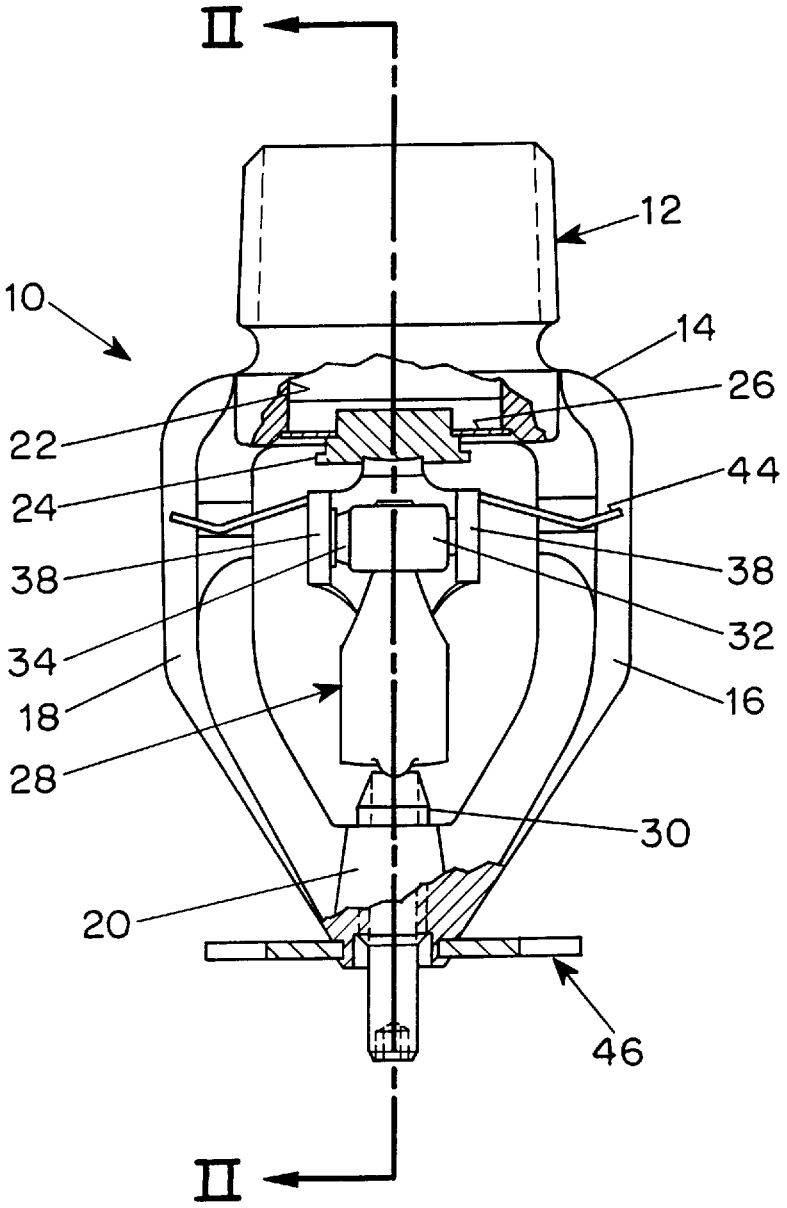
FIG. 1 is side view, partly in section, illustrating a representative embodiment of a sprinkler made in accordance with the invention.
Figure 2:
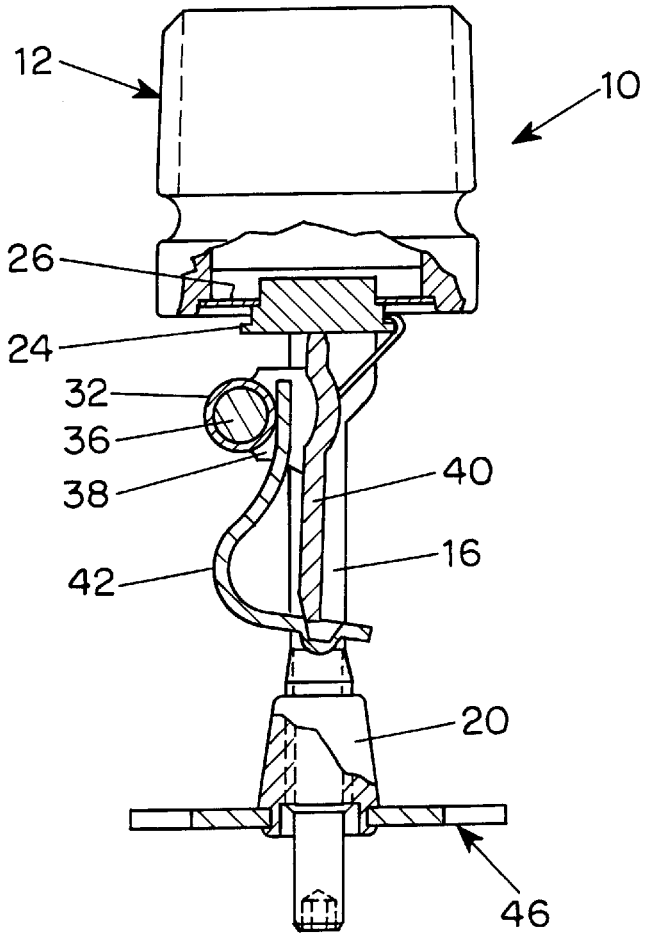
FIG. 2 is a side view, partly in section, of the sprinkler shown in FIG. 1 taken along the line II—II of FIG. 1 and looking in the direction of the arrows.

In the typical embodiment of the invention shown in the drawings, a pendent sprinkler 10 has a threaded end 12 adapted to be connected to a pipe to supply water under pressure and a frame 14 consisting of two arms 16 and 18 extending from opposite sides of the threaded end 12 and joined at a boss 20 which is positioned on the sprinkler axis and spaced from the threaded end 12. The threaded end 12 is formed with an axial internal passage 22 to direct a stream of water under pressure axially toward the boss 20 and is normally closed by a cap 24 fitted in a washer 26 which is seated on a shoulder at the end of the passage 22. The sealing cap 24 is retained in its passage-closing position by a conventional thermally responsive arrangement 28 which extends between the cap 24 and a screw 30 threaded through the boss 20.

In the illustrated embodiment, the thermally responsive arrangement 28 includes a cylinder 32 containing a ball 34 at one end which is held in position by a block 36 of solder arranged to be fused at a selected elevated temperature such as 160° Fahrenheit. In the unfused condition illustrated in the drawings, the cylinder 32 is retained between projecting arms 38 on a strut member 40 to restrain a lever member 42 in a strut-supporting position so as to hold the cap 24 and its associated washer 26 in passage-closing position. When the eutectic material fuses in response to an elevated temperature, the cylinder 32 is released from the arms 38 of the strut 40, permitting the lever 42 to pivot outwardly, thereby releasing the strut from its cap-supporting position. To facilitate removal of the strut and lever assembly from the path of water emerging from the passage 22 a spring 44 extending between the frame arms 16 and 18 engages the strut 40. The water projected axially through the passage 22 is therefore directed along an unimpeded path toward a deflector 46 which is mounted on the boss 20 and is arranged to divert the water radially outwardly so as to be dispersed over the region to be protected. Alternatively, if desired, any other conventional temperature-responsive arrangements, such as a glass bulb, may be substituted for the temperature-responsive arrangement 28. Moreover, for deluge-type applications, the flow of water through the sprinkler may be controlled by a remote valve in the water supply line rather than a thermally responsive arrangement in the sprinkler.

Figure 3:
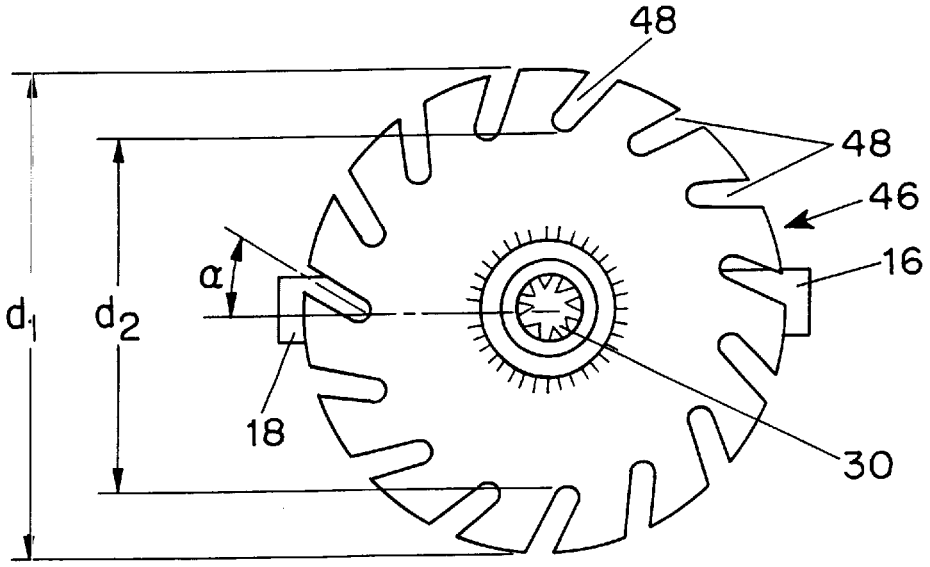
FIG. 3 is an end view of the sprinkler shown in FIGS. 1 and 2 illustrating the arrangement of the sprinkler deflector.

In the illustrated embodiment, the deflector 46 has a planar configuration and, as best seen in FIG. 3, to facilitate an increased density of water distribution over the area to be protected, the deflector is provided with a circumferential array of slots 48 which extend inwardly from the periphery of the deflector at an angle $\alpha$ to a radial line extending through the inner end of the slot as shown in FIG. 3. Preferably, the angle a is within the range from about 20° to about 50°, desirably about 30° to about 40°, and most desirably about 35°.

In a preferred embodiment arranged for maximum water density distribution over an area up to about 10 feet by 10 feet and located approximately 10 feet below the sprinkler, the deflector 46 has a diameter $d_1$ in the range from about 1.10 inches to about 1.20 inches and preferably about 1.15 inches. The root diameter $d_2$ at the inner ends of the slots 48 is preferably about 0.6 inch to about 1.0 inch, desirably about 0.7 inch to about 0.9 inch and most desirably about 0.85 inch. In this embodiment there are 15 slots spaced uniformly in the circumferential direction but a larger or smaller number of slots may be used. Each slot preferably has a width of about 0.04 inch to about 0.08 inch.

By using such angularly oriented slots, some of the water from the axial passage 22 is permitted to pass through the deflector 46 over substantially the entire circumferential peripheral area of the deflector, rather than only at selected angular positions, providing more uniform water distribution. As a result, more water is supplied to the threatened region in the same time period and the water is supplied more uniformly over the region, thereby improving the ability to contain a fire with its initial ignition location and to extinguish the fire which has already been ignited. Thus, a deflector arrangement having slots disposed at an angle to a radial line has been found to provide increased water density, in gallons per square foot per minute, and more uniform distribution in the area to be protected, in comparison with a sprinkler having the same number of slots of the same width and the same root diameter but oriented along a radial line.

Although the invention has been described herein with reference to specific embodiments, many modifications and variations therein will readily occur to those skilled in the art. Accordingly, all such variations and modifications are included within the intended scope of the invention.

I claim:

1. A sprinkler comprising a sprinkler body having an axial passage for delivery of fire extinguishing liquid, a pair of arms extending from the sprinkler body in a plane parallel to the sprinkler axis, a deflector supported by the pair of arms and having a planar surface facing the sprinkler body which extends to the periphery of the deflector, the deflector being positioned in a plane generally perpendicular to the axis of the sprinkler body and having a circumferential array of slots each extending inwardly from the periphery of the deflector and intercepting the periphery of the deflector at an angle of at least 20° to a radial line extending though the inner end of the slot.

2. A sprinkler according to claim 1 wherein each slot is at an angle to the radial line in the range from about 20° to about 50°.

3. A sprinkler according to claim 1 wherein each slot is oriented at an angle to the radial line in the range from 30° to about 40°.

4. A sprinkler according to claim 3 wherein each slot is oriented at an angle to the radial line of approximately 35°.

5. A sprinkler according to claim 1 wherein the deflector has a substantially planar configuration.

6. A sprinkler according to claim 1 wherein the deflector has a diameter in the range from about 1.05 inch to about 1.25 inch.

7. A sprinkler according to claim 6 wherein the deflector has a diameter in the range from about 1.10 inch to about 1.20 inch.

8. A sprinkler according to claim 7 wherein the deflector has a diameter of about 1.15 inch.

9. A sprinkler according to claim 1 wherein each slot has a width in the range from about 0.04 inch to about 0.08 inch.

10. A sprinkler according to claim 9 wherein each slot has a width of about 0.06 inch.

11. A sprinkler according to claim 1 wherein the root diameter of each of the slots is in the range from about 0.6 inch to about 1.0 inch.

12. A sprinkler according to claim 11 wherein the root diameter of each of the slots is in the range from about 0.7 inch to about 0.9 inch.

13. A sprinkler according to claim 12 wherein the root diameter of each of the slots is approximately 0.85 inch.

14. A sprinkler according to claim 1 wherein the pair of arms extending from the sprinkler body meet at a boss at a location on the sprinkler axis spaced from the sprinkler body and the deflector is supported from the boss.

15. A sprinkler according to claim 1 wherein the number of slots in the circumferential array is 15.

* * * * *

UNITED STATES PATENT AND TRADEMARK OFFICE

CERTIFICATE OF CORRECTION

PATENT NO. : 5,890,657

DATED : April 6, 1999

INVENTOR(S) : GARY W. PONTE

It is certified that error appears in the above-indentified patent and that said Letters Patent is hereby corrected as shown below:

Column 1, line 59: "200" and "500" should read --20°-- and --50°--.

Column 1, line 60: "300" and "400" should read --30°-- and --40°--.

Column 1, line 61: "350" should read --35°--.

Column 3, line 3: "a" should read --α--.

Signed and Sealed this

Sixth Day of July, 1999

*Attest:*

*Attesting Officer*

Q. TODD DICKINSON

*Acting Commissioner of Patents and Trademarks*